US005242235A

United States Patent [19]

Li

[11] Patent Number: 5,242,235

[45] Date of Patent: Sep. 7, 1993

[54] TOOTHBRUSH

[76] Inventor: Jianxing Li, 238 Princeton Ave. #3, Amherst, N.Y. 14226

[21] Appl. No.: 924,953

[22] Filed: Aug. 5, 1992

[51] Int. Cl.[5] ..... A46B 9/04; A46B 11/00; A46B 9/10

[52] U.S. Cl. ..... 401/268; 401/290; 15/104.94; 15/167.1; 15/176.5

[58] Field of Search ..... 15/104.94, 167.1, 176.4, 15/176.5, 201, 202, 207.2; 401/268, 290

[56] References Cited

U.S. PATENT DOCUMENTS

| | | | |
|---|---|---|---|
| Re. 19,006 | 11/1933 | Graves | 15/104.94 |
| T903,031 | 10/1972 | Davis | 401/268 |
| 726,716 | 4/1903 | Maher | 15/201 |
| 1,212,001 | 1/1917 | Baxter | 15/167.1 |
| 1,620,330 | 3/1927 | Douglass | 15/146 |
| 1,664,797 | 4/1928 | Stone | 15/201 |
| 1,929,530 | 10/1933 | Abelson | 15/167.1 |
| 2,161,349 | 6/1939 | Hadden | 15/167.1 |
| 2,172,624 | 9/1939 | Robert | 401/268 |
| 2,435,394 | 2/1948 | Hawley | 15/167.1 |
| 3,316,580 | 5/1967 | Tebbs | 15/104.94 |
| 3,879,791 | 4/1975 | Isler | 15/201 |
| 4,619,345 | 10/1986 | Rands | 15/104.94 |

FOREIGN PATENT DOCUMENTS

| | | | |
|---|---|---|---|
| 549168 | 11/1957 | Canada | 15/104.94 |
| 9008488 | 8/1990 | PCT Int'l Appl. | 15/167.1 |

*Primary Examiner*—Timothy F. Simone
*Assistant Examiner*—Randall E. Chin
*Attorney, Agent, or Firm*—S. Michael Bender

[57] ABSTRACT

A new and improved toothbrush construction comprising spaced groups of bristles extending from the head of the brush. In an alternative embodiment, the bristle groups are supported on slidable elements which may be adjustably positioned and then locked into place on the toothbrush head thereby permitting the spacing of the bristle groups to be varied in accordance with personal requirements. In yet another embodiment, the individual bristles are provided with longitudinally spaced conical protrusions for facilitating the delivery of a hygienic substance or dentifrice to the teeth.

5 Claims, 4 Drawing Sheets

FIG 5
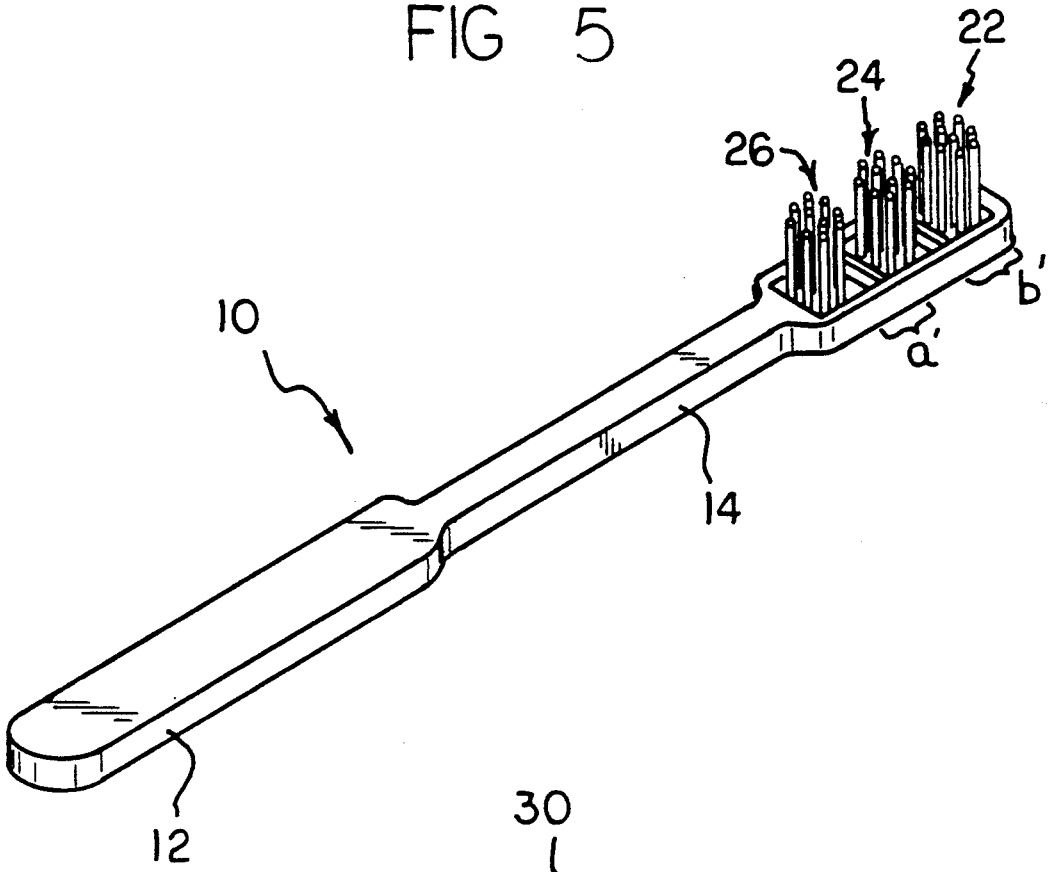
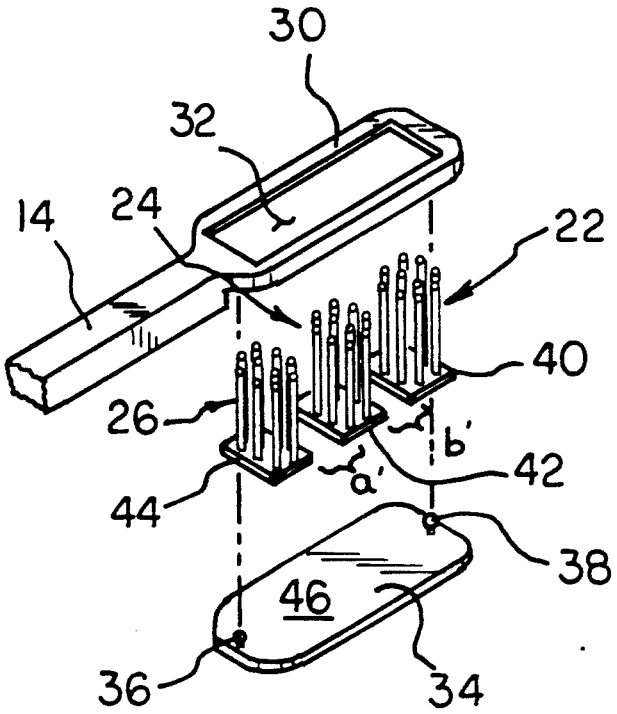
FIG 6

FIG 7
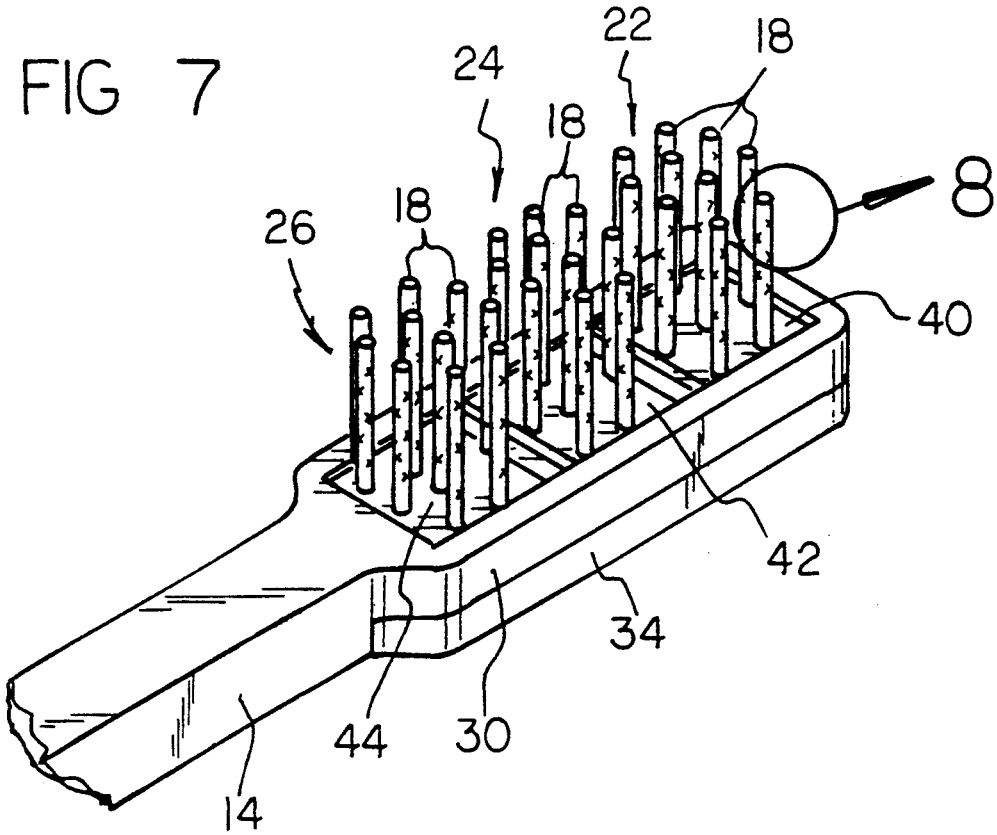
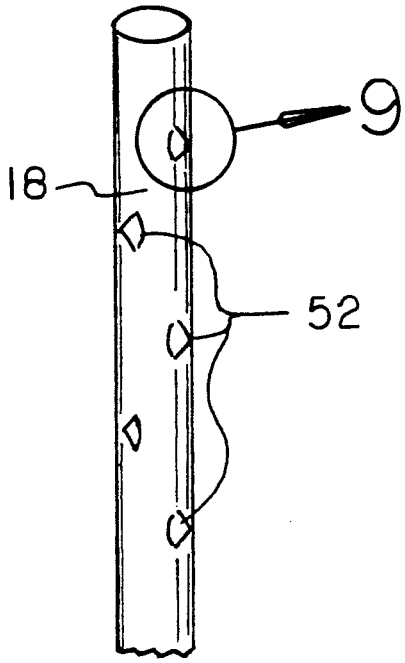
FIG 8
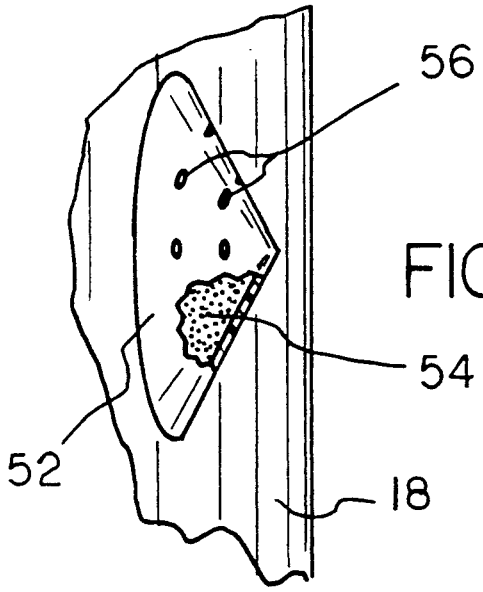
FIG 9

TOOTHBRUSH

BACKGROUND OF THE INVENTION

1. Field of the Invention

The present invention relates generally to toothbrushes, and more particularly, to toothbrushes having spaced bristles groups on the head of the brush.

2. Description of the Prior Art

A wide variety of prior toothbrush constructions are well known, especially toothbrushes having different bristle arrangements. For example, U.S. Pat. No. 4,888,844 discloses a toothbrush having bristles covering the entire head of the brush similar to the configuration of a "dust mop". In U.S. Pat. No. 4,852,202 there is shown a toothbrush head arrangement wherein several rows of straight bristle perpendicular to the head are surrounded by several rows of bristle arranged at an angle of 45 degrees with respect to the head. Finally, in U.S. Pat. No. 4,800,608 a toothbrush with a curved head section and a straight head section is shown with the bristles extending from the curved section being oriented at an angle with respect to the bristles extending from the straight section of the head.

In each of these prior art toothbrush variations, a high, substantially uniform bristle density is employed. As a result, it is difficult, in not impossible, for adequate bristle contact in the regions between two adjacent teeth inasmuch as the neighboring bristles in a high density layout exert reaction forces against the toothbrush head thereby interfering with optimal bristle/-teeth engagement. The foregoing disadvantage is overcome by the unique bristle arrangement of the present invention as will be made apparent from the following description thereof. Other advantages of the present invention over the prior art designs will also be rendered evident.

SUMMARY OF THE INVENTION

To achieve the foregoing and other advantages, the present invention, briefly described, provides a new and improved toothbrush construction comprising spaced groups of bristles extending from the head of the brush. In an alternative embodiment, the bristle groups are supported on slidable elements which may be adjustably positioned and then locked into place on the toothbrush head thereby permitting the spacing of the bristle groups to varied in accordance with personal requirements. In yet another embodiment, the individual bristles are provided with longitudinally spaced conical protrusions for facilitating the delivery of a hygienic substance or dentifrice to the teeth.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least three preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved toothbrush which has all of the advantages of the prior art and none of the disadvantages.

It is another object of the present invention to provide a new an improved toothbrush which may be easily and efficiently manufactured and marketed.

It is a further objective of the present invention to provide a new and improved toothbrush which is of durable and reliable construction.

An even further object of the present invention is to provide a new and improved toothbrush which is susceptible of a low cost of manufacture with regard to both materials and labor, and which accordingly is then susceptible of low prices of sale to the consuming public, thereby making such toothbrush economically available to the buying public.

Still a further object of the present invention is to provide a new and improved toothbrush which provides in the apparatuses and methods of the prior art some advantage thereof, while simultaneously overcoming some of the disadvantages normally associated therewith.

Still yet a further object of the present invention is to provide a new and improved toothbrush capable of more effectively cleaning teeth.

Still a further object of the present invention is to provide a new and improved toothbrush comprising spaced groups of bristles adapted to more efficiently engage the spaces between adjacent teeth.

Still a further object of the present invention is to provide a new and improved toothbrush comprising spaced groups of bristles adapted to be adjusted relative to each other to suit personal requirements.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 5 is a perspective view in elevation of a second preferred embodiment of the invention.

FIG. 6 is a partial perspective view in elevation of a portion of the third second preferred embodiment of the invention shown in FIG. 5.

FIG. 7 is a perspective view of a portion of a third alternatively preferred embodiment of the invention.

FIG. 8 is enlarged perspective view of a bristle employed in the alternatively preferred embodiment of FIG. 7.

FIG. 9 is an enlarged detail view in perspective of a portion of the bristle shown in FIG. 8.

DESCRIPTION OF THE PREFERRED EMBODIMENT

Figure 1:
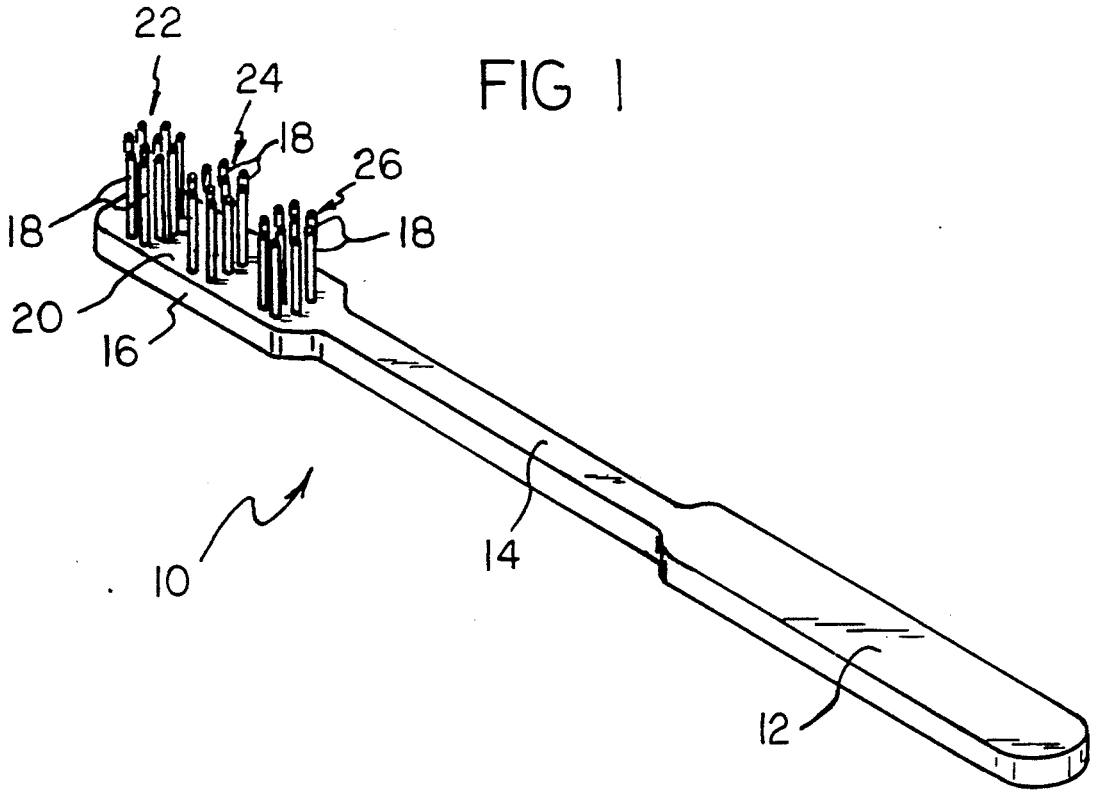
FIG. 1 is a perspective view showing the first preferred embodiment of the toothbrush of the present invention.
Figure 2:
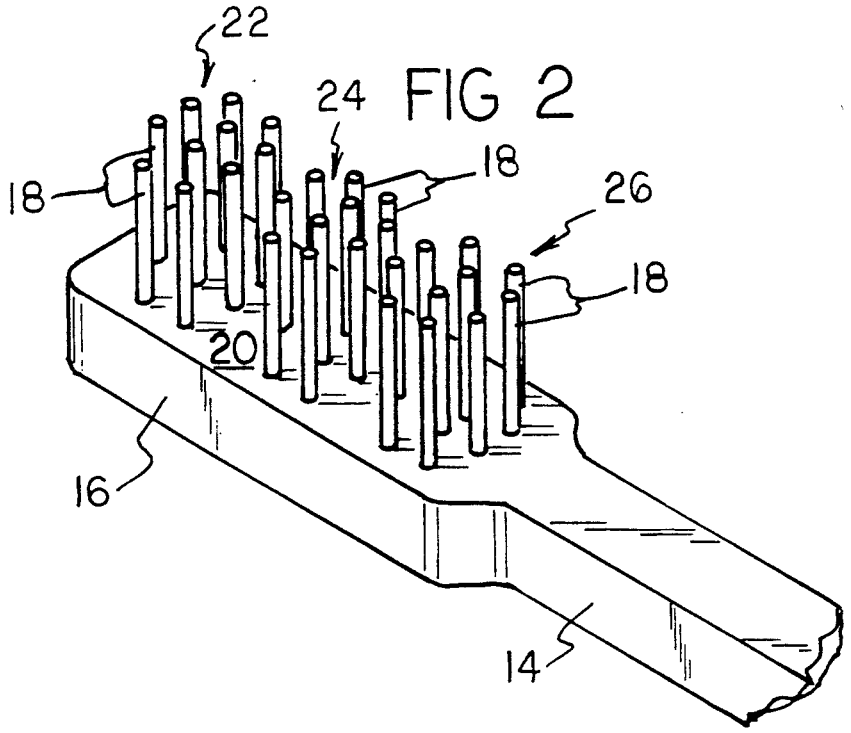
FIG. 2 is a partial perspective of the head of the toothbrush of FIG. 1.
Figure 3:
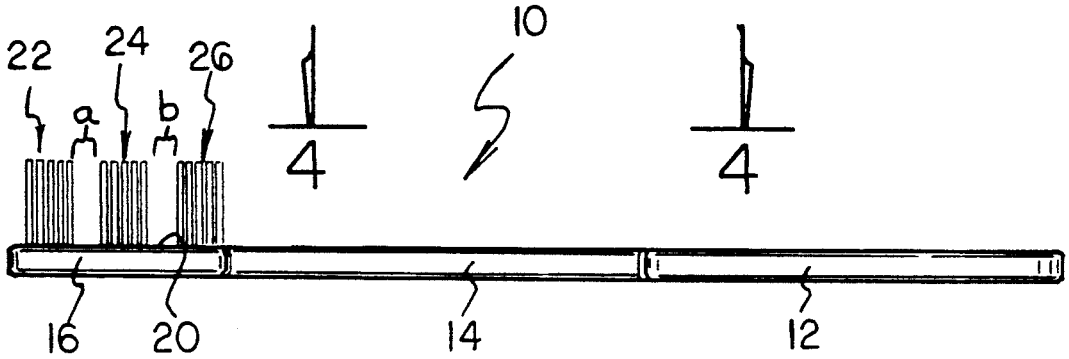
FIG. 3 is a front view in elevation of the preferred embodiment of the invention shown in FIGS. 1 and 2.

With reference now to the drawings, a new and improved toothbrush embodying the principles and concepts of the present invention will be described.

Turning initially to FIGS. 1–4, there is shown a first preferred form of the toothbrush of the invention generally designated by reference numeral 10. Toothbrush 10 comprises a posterior handle portion 12, a reduced width intermediate portion 14, and an anterior or head portion 16 with the separate portions being generally longitudinally aligned substantially as shown.

In a conventional manner, head portion 16 is generally rectangular in shape and forms a platform or support for a multiplicity of bristles 18 extending perpendicular with respect to the top surface 20 of the head portion. The bristles preferably are fabricated from a suitable material such as nylon filament, for example, and are affixed to the head portion in a well known manner. It will be appreciated that the number of strands or filaments employed is largely a matter of choice and that for purposes of illustrating the invention the individual strands have been shown enlarged in size and greatly reduced in number.

Figure 4:
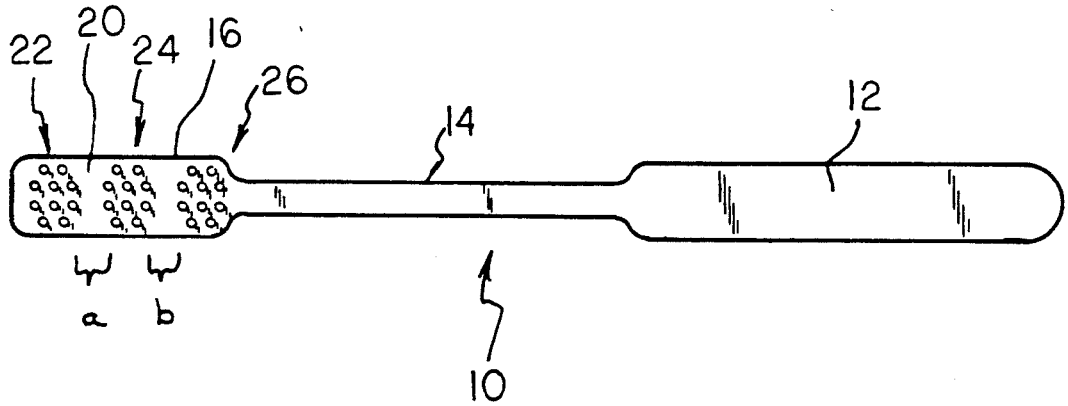
FIG. 4 is a top plan view of the embodiment of FIG. 3 taken along line 4—4 of FIG. 3.

According to an important feature of the invention, the bristles 18 are divided into a series of spaced clumps or groups generally designated by reference numerals 22, 24, and 26. In other words, the packing density of the bristles supported by the head portion of the toothbrush is non-uniform. It has been discovered that by providing a space between the individual clusters of bristles, access of the bristle tips to the concave spaces between adjacent teeth is greatly enhanced particularly in the region where the gingiva terminates, i.e. the so-called "gum line." As best seen in FIGS. 4 and 5, the spacing between bristle clusters 22, 24 is indicated by the letter "a" whereas the spacing between bristle clusters 24, and 26 is indicated by the letter "b." Preferably, the magnitude of spacings "a" and "b" is equal to the average span of an adult tooth or approximately in the range of say, from about 3/16 inches to about ¼ inches. Although in the preferred embodiment of FIGS. 1–4, the bristle group spacing dimensions "a" and "b" are shown to be equal, it will be appreciated that these distances may be unequal, if desired. This variation is particularly advantageous when used to clean teeth having lateral spans that vary more than usual. The transverse cross-sectional shape of the bristle groups also is a matter of convenient choice. Thus, when viewed from above in FIG. 4, the shape of the clusters may be circular, elliptical, square, rectangular and so on, or combinations of same.

In use, the toothbrush of the present invention is used in a conventional manner to clean teeth. However, because of the novel spaced relation of the bristles according to the invention, it will immediately be noticed that there is increased contact in the regions between adjacent teeth. This is believed to arise because during brushing the spaced groups of bristles straddle each tooth and thereby reduces bristle engagement against the convex central surface of each tooth. In the prior or conventional toothbrush, the engagement between the bristles in the center of the head of the brush with the central surface of a tooth tends to urge the bristles at either opposed end of the head of the brush away from the confronting lateral tooth surfaces, an action avoided by the novel design of the toothbrush of the present invention.

Turning now to FIGS. 5 and 6 there is shown an alternatively preferred embodiment of the invention wherein like reference numerals represent like parts. In the prior embodiment of FIGS. 1–4, it was pointed out how the various bristle groups 22, 24, and 26 may have different spacings "a" and "b" therebetween. In the exemplary embodiment of FIGS. 5 and 6 means are provided for adjustably varying distances "a" and "b". The head portion comprises a rectangular shaped frame 30 integrally joined to intermediate portion 14 and extending distally therefrom to form a similarly shaped opening or window 32. A backing plate 34 of substantially the same size and shape (no opening therein) has a pair of integral rounded nubs or detents 36, 38 for engaging a corresponding pair of suitable holes (not shown) located on the underside of frame 30 at either extremity thereof. By this arrangement, backing plate 34 may be selectively removed and then lockingly secured to frame 30. A series of three relatively thin plates or support elements 40, 42, and 44 is provided each of which suitably supports in a known manner a corresponding bristle group 22, 24, and 26 substantially as shown. The plates 40, 42, 44 are suitably sized so as to be slidable on surface 46 of backing plate 34 yet securely retained by frame 30 when the backing plate is affixed to the frame via detents 36, 38. As shown to best advantage in FIG. 5, when the plates 40, 42, 44 are in their secured position between frame 30 and backing plate 34, the bristle groups, or more precisely, their support plates, are separated by the distances "a" and "b". All that is necessary to adjust distances "a" and "b" is to remove backing plate 34, slidably adjust plates 40, 42, and 44 to their desired positions on backing plate 34, and lockingly secure the backing plate to the frame. Hence, the alternatively preferred embodiment has the advantage of providing means for adjusting the spacing between the bristle clusters to suit individual preferences and requirements.

Turning now to FIGS. 7–9, there is shown yet another alternatively preferred embodiment of the invention wherein the individual bristles in each separate cluster are provided with means for effectively delivering a hygienic substance or dentifrice to the teeth during brushing. Here again, like reference numerals represent similar parts with respect to those already described, and the bristles are shown greatly enlarged in the drawing for the sake of clarity. Each individual bristle 18 has suitably disposed along its shaft a series of spaced protrusions 52 each of which preferably is conically shaped (FIG. 9). The protrusions serve as minute containers for a powdered dentifrice such as baking soda, for example, indicated generally by reference numeral 54, and each includes a multiplicity of weep holes 56 allowing the baking soda particles to pass through the weep holes and onto the teeth during brushing. When the dentifrice particles are exhausted, the backing plate 34 may be removed from frame 30 and fresh or replacement bristle clusters inserted in place of the exhausted ones. It is thus seen, that by virtue of the unique construction of the toothbrush according to the invention, the bristle clusters not only are adjustable, they are replaceable as well.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadset interpretation of the appended claims so as encompass all such modifications and equivalents.

What is claimed as being new and desired to be protected by Letters Patent of the United States is as follows:

1. A new and improved toothbrush comprising:

a handle, a head joined to said handle, said head having at least one surface adapted to support bristles, first and second groups of bristles supported on said at least one surface of said head and extending therefrom, said first and second groups of bristles being spaced from one another on said at least one surface, wherein said first and said second groups of bristles are mounted on support elements respectively, said support elements being adapted for slidable displacement on said at least one surface, and said head includes means for securing said elements on said at least one surface, wherein said means for securing comprises a frame joined to said handle and extending longitudinally therefrom, said frame defining a window, and closure means for said frame, said closure means supporting said elements in said frame whereupon said bristles extend therefrom through said window and said closure means defines said at least one surface, and wherein said closure means is removably attachable to said frame whereby the distance between said elements may be adjusted upon removal and subsequent re-attachment of said closure means relative to said frame.

2. The toothbrush of claim 1 further comprising:

a third group of bristles supported on said at least one surface and extending therefrom, said third group of bristles being spaced from said first and second groups of bristles, respectively, said third group of bristles being mounted on a corresponding support element, said support element for said third group of bristles being adapted for slidable displacement on said at least one surface proximal to the support elements for said first and said second groups of bristles.

3. The toothbrush of claim 1 wherein at least some of the bristles in either said first or second group have containers thereon, said containers comprising means for storing a dentifrice, said containers having passages thereon adapted to permit said dentifrice to be delivered to the teeth being engaged by said toothbrush.

4. The toothbrush of claim 3 wherein said dentifrice comprises baking soda.

5. The invention claim 4 wherein said containers are conically shaped.

* * * * *